US008771438B2

(12) United States Patent
Lee et al.

(10) Patent No.: US 8,771,438 B2
(45) Date of Patent: Jul. 8, 2014

(54) PLASMA NITRIDING SURFACE TREATMENT METHOD FOR GRAY CAST IRON PART

(75) Inventors: Jae Young Lee, Gyeonggi-do (KR); Seong Jin Kim, Gyeonggi-do (KR); Jai Min Han, Gyeonggi-do (KR); Yoon Cheol Kim, Gyeonggi-do (KR); Hyun Dal Park, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 19 days.

(21) Appl. No.: 13/614,983

(22) Filed: Sep. 13, 2012

(65) Prior Publication Data

US 2013/0284318 A1 Oct. 31, 2013

(30) Foreign Application Priority Data

Apr. 27, 2012 (KR) ..... 10-2012-0044308

(51) Int. Cl.
*C23C 8/38* (2006.01)
*C23C 8/34* (2006.01)
*C23C 8/26* (2006.01)

(52) U.S. Cl.
USPC ..... 148/222; 148/217; 148/238

(58) Field of Classification Search
CPC ..... C23C 8/36
USPC ..... 148/222, 217, 238
See application file for complete search history.

(56) References Cited

U.S. PATENT DOCUMENTS

| | | | |
|---|---|---|---|
| 2002/0036033 | A1 | 3/2002 | Subramanian |
| 2011/0079326 | A1 | 4/2011 | Hanna et al. |
| 2011/0293849 | A1 | 12/2011 | Lembach et al. |

FOREIGN PATENT DOCUMENTS

| | | | |
|---|---|---|---|
| JP | 02179864 | A | 7/1990 |
| JP | 2000337410 | A | 12/2000 |
| KR | 10-0146882 | B1 | 5/1998 |
| KR | 10-0924275 | | 10/2009 |

OTHER PUBLICATIONS

ASM International, Materials Park, Ohio, Heat Treating, "Introduction to Surface Hardening of Steels", Mar. 1990, vol. 1, pp. 259-267.*

* cited by examiner

*Primary Examiner* — Jessee Roe
(74) *Attorney, Agent, or Firm* — Edwards Wildman Palmer LLP; Peter F. Corless

(57) ABSTRACT

Disclosed is a plasma nitriding surface treatment method for a gray cast iron part. In the plasma nitriding surface treatment method, a nitride layer is formed on a surface of the gray cast iron part by a selective ion nitriding treatment. The plasma nitriding surface treatment method is carried out such that the surface of the gray cast iron part is prevented from being deformed, and a reduction of the frictional coefficient of the part is prevented.

7 Claims, 5 Drawing Sheets

PRIOR ART

<A-A CROSS-SECTION>

PRIOR ART

PLASMA NITRIDING SURFACE TREATMENT METHOD FOR GRAY CAST IRON PART

CROSS-REFERENCE TO RELATED APPLICATION

This application claims under 35 U.S.C. §119(a) the benefit of Korean Patent Application No. 10-2012-0044308 filed Apr. 27, 2012, the entire contents of which are incorporated herein by reference.

BACKGROUND (a) Technical Field

The present invention relates to a plasma nitriding surface treatment method for a gray cast iron part. More particularly, it relates to a plasma nitriding surface treatment method for a gray cast iron part, which can improve the exterior of the part by preventing the occurrence of rust.

(b) Background Art

Generally, brake discs serve to stop vehicles by changing kinetic energy of a moving vehicle into thermal energy by friction between the discs and frictional materials. As such, brake discs require very efficient heat radiation capacity.

In order to meet these requirements, brake discs are primarily being manufactured using gray cast iron, which is a cheap material having sufficient heat radiation characteristics.

A brake disc formed of gray cast iron, which is a frictional material, may undergo nitriding treatment to increase abrasion resistance.

FIG. 1 is a view illustrating a method of oxy-nitriding a brake disc according to a related art. In the oxy-nitriding method of a brake disc 10, the brake disc 10 is put into a furnace, and undergoes an oxy-nitriding treatment for 4 to 5 hours at a temperature of 500° C. to 700° C. under an atmosphere where oxygen ($O_2$) is added to ammonia gas ($NH_3$) to form an oxy-nitride layer on the surface of a gray cast iron.

For example, a process of forming an oxy-nitride layer as shown in FIG. 1 includes performing a nitriding process for 250 minutes at a temperature of 610° C. under an atmosphere of ammonia ($NH_3$), nitrogen ($N_2$), and carbon dioxide ($CO_2$), performing an oxidizing process for 20 minutes at a temperature of 555° C. using water vapor, and performing natural air cooling.

Table 1 shows the thickness variation of the brake disc 10 oxy-nitrided by the above method before and after the oxy-nitriding.

TABLE 1

| Item | Sample | After grinding | After oxy-nitriding | Variation |
|---|---|---|---|---|
| Disc thickness measurement (Thickness: 28 mm) | 1 | 28.020 | 28.040 | 0.020 |
| | 2 | 28.020 | 28.050 | 0.030 |
| | 3 | 28.020 | 28.040 | 0.020 |
| | 4 | 28.020 | 28.050 | 0.020 |
| | 5 | 28.020 | 28.050 | 0.030 |

As shown in Table 1, the thickness of the brake disk 10 increase by about 20 μm to about 30 μm after the oxy-nitriding due to a porous layer.

Upon oxy-nitriding, a nitride layer of an epsilon (ϵ) phase is formed on the surface by a reaction of gray cast iron and atmospheric oxygen. This nitride layer of the epsilon phase increases brittleness. Furthermore, due to the porous layer, corrosion on the frictional surface becomes severe, and surface peeling occurs upon braking.

The above information disclosed in this Background section is only for enhancement of understanding of the background of the invention and therefore it may contain information that does not form the prior art that is already known in this country to a person of ordinary skill in the art.

SUMMARY OF THE DISCLOSURE

The present invention provides a plasma nitriding surface treatment method for a gray cast iron part. The surface treatment method improves the abrasion resistance of frictional materials and further improves the exterior of gray cast iron parts by preventing of corrosion of a frictional surface of the gray cast iron part. In particular, the surface treatment method of the present invention prevents generation of a nitride layer of an epsilon phase on the frictional surface, and instead generates a nitride layer of a gamma prime (γ') phase with dense texture, thereby preventing corrosion.

In one aspect, the present invention provides a plasma nitriding surface treatment method for a gray cast iron part, including forming a nitride layer on a surface of the gray cast iron part by a selective ion nitriding treatment, wherein the surface of the gray cast iron part is prevented from being deformed, and the frictional coefficient of the gray cast iron part is maintained.

In an exemplary embodiment, the ion nitriding treatment is performed by a plasma nitriding treatment process to minimize generation of an epsilon phase and induce generation of a gamma prime phase.

In another exemplary embodiment, the ion nitriding treatment is performed at a temperature of about 400° C. to about 550° C. for about 120 minutes to about 300 minutes.

In still another exemplary embodiment, during the ion nitriding treatment which is carried out in an ion nitriding atmosphere, carbon is inhibited to induce generation of a single phase of a gamma prime and inhibit generation of a compound phase of the gamma prime.

In yet another exemplary embodiment, the method may further include forming an oxide layer ($Fe_3O_4$) on the surface of the gray cast iron part after formation of the nitride layer thereon. The oxide layer can be formed using a salt bath oxidation process or vapor to inhibit formation of a porous layer and facilitate an infiltration of nitrogen atoms.

In still yet another exemplary embodiment, the oxide layer is formed by a salt bath oxidation process performed for about 20 minutes to 60 minutes to prevent oxidation of the surface of the part and deformation of the part such that the porous nitride layer is corroded to reduce the thickness of the compound layer. As referred to herein, a compound layer refers to the nitride and oxide layers formed on the part.

In a further exemplary embodiment, during an oxidation time a temperature of about 200° C. to about 500° C. is maintained to form the oxide layer so as to increase an infiltration depth of the oxide layer.

Other aspects and exemplary embodiments of the invention are discussed infra.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
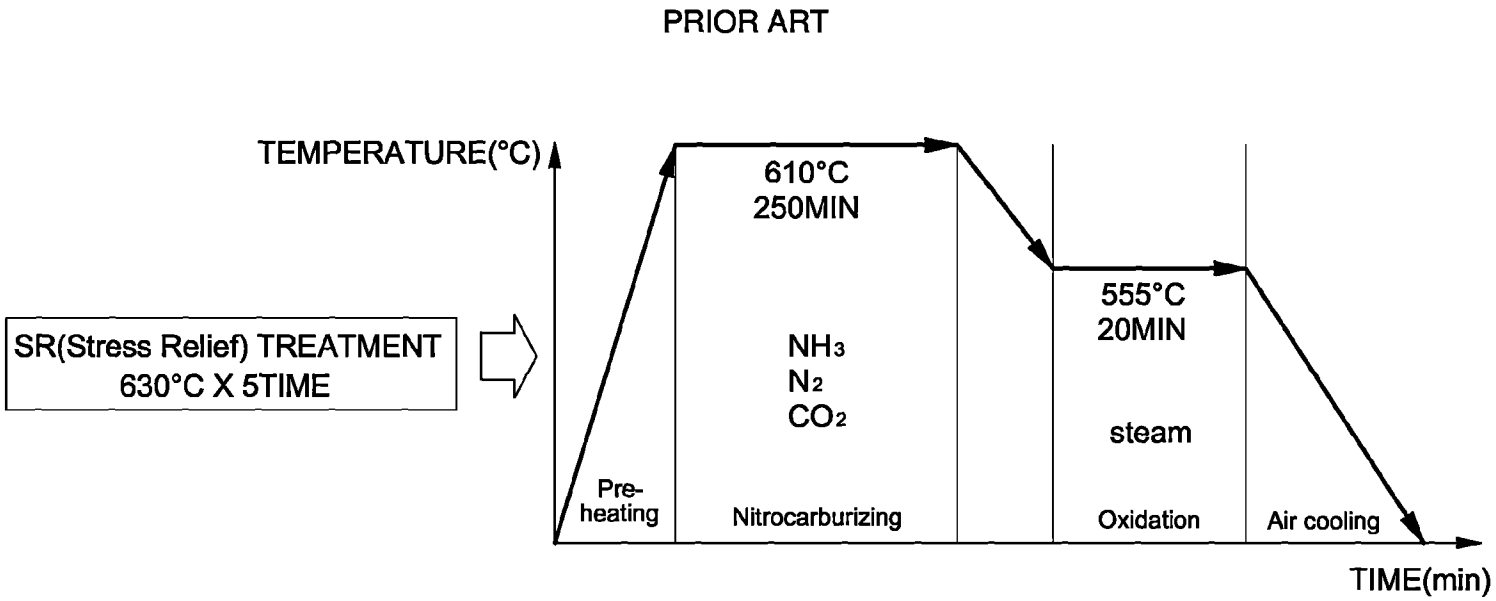
FIG. 1 is a graph illustrating a typical brake disc oxy-nitriding treatment method.
Figure 2:
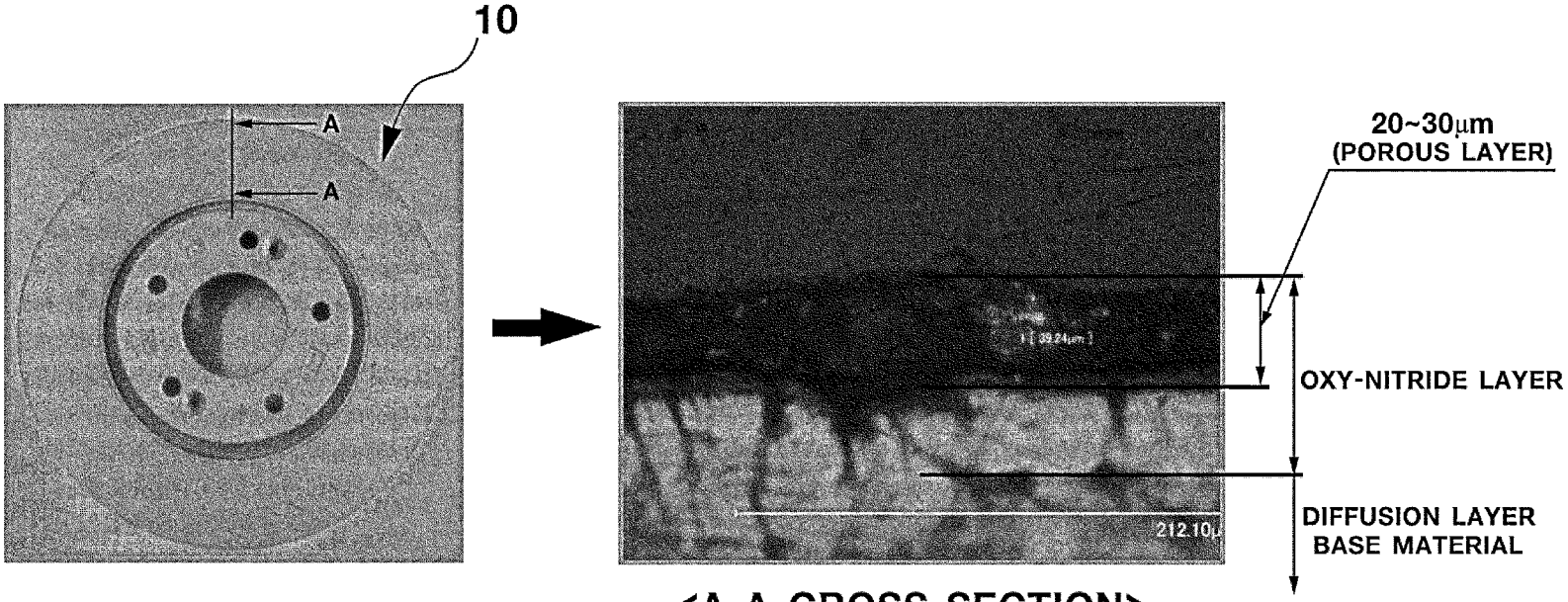
FIG. 2 is a magnified photograph of a typical oxy-nitrided brake disc and a surface thereof.
Figure 3:
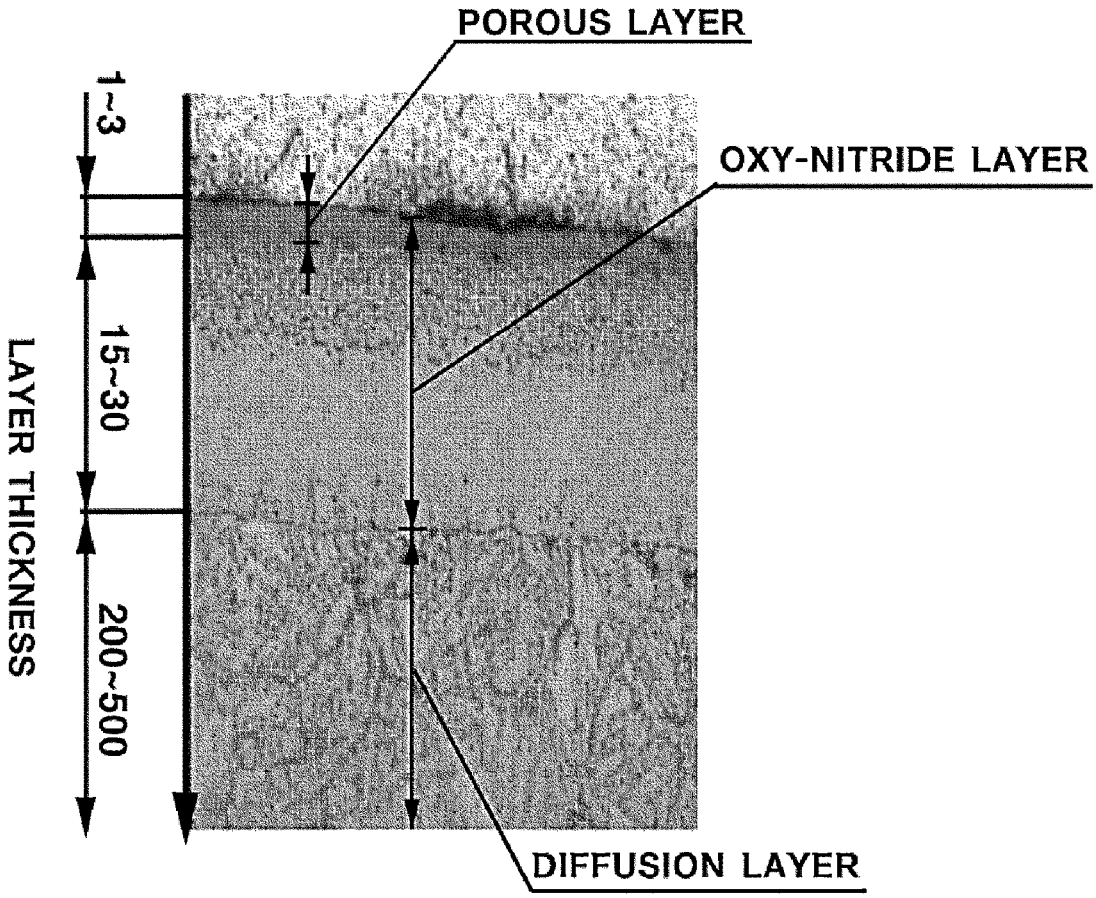
FIG. 3 is a cross-sectional view illustrating a surface thickness of a typical oxy-nitrided brake disc.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Ranges provided herein are understood to be shorthand for all of the values within the range. For example, a range of 1 to 50 is understood to include any number, combination of numbers, or sub-range from the group consisting of 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50, as well as all intervening decimal values between the aforementioned integers such as, for example, 1.1, 1.2, 1.3, 1.4, 1.5, 1.6, 1.7, 1.8, and 1.9. With respect to sub-ranges, "nested sub-ranges" that extend from either end point of the range are specifically contemplated. For example, a nested sub-range of an exemplary range of 1 to 50 may comprise 1 to 10, 1 to 20, 1 to 30, and 1 to 40 in one direction, or 50 to 40, 50 to 30, 50 to 20, and 50 to 10 in the other direction.

The above and other features of the invention are discussed infra.

Figure 4:
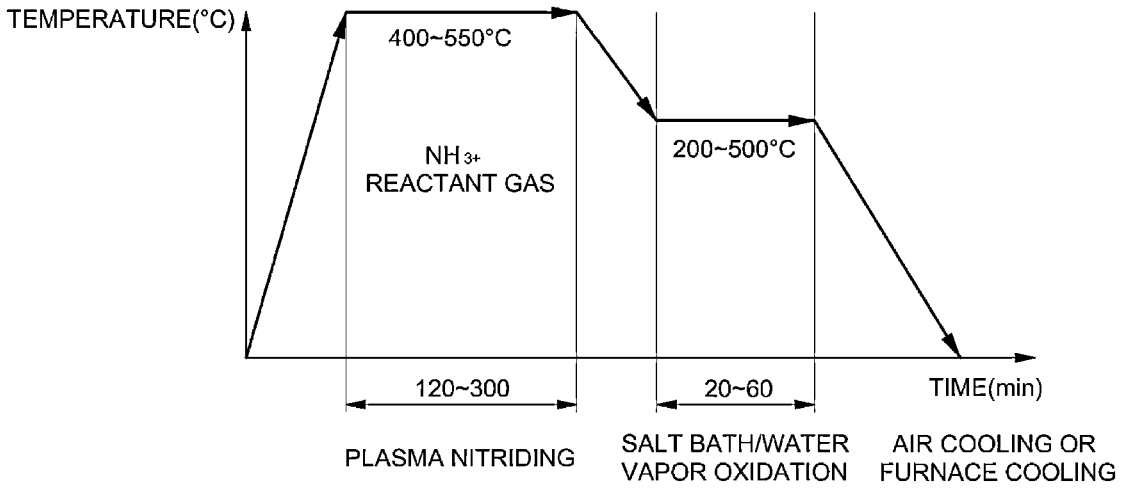
FIG. 4 is a graph illustrating a brake disc oxy-nitriding treatment method according to an embodiment of the present invention.
Figure 5:
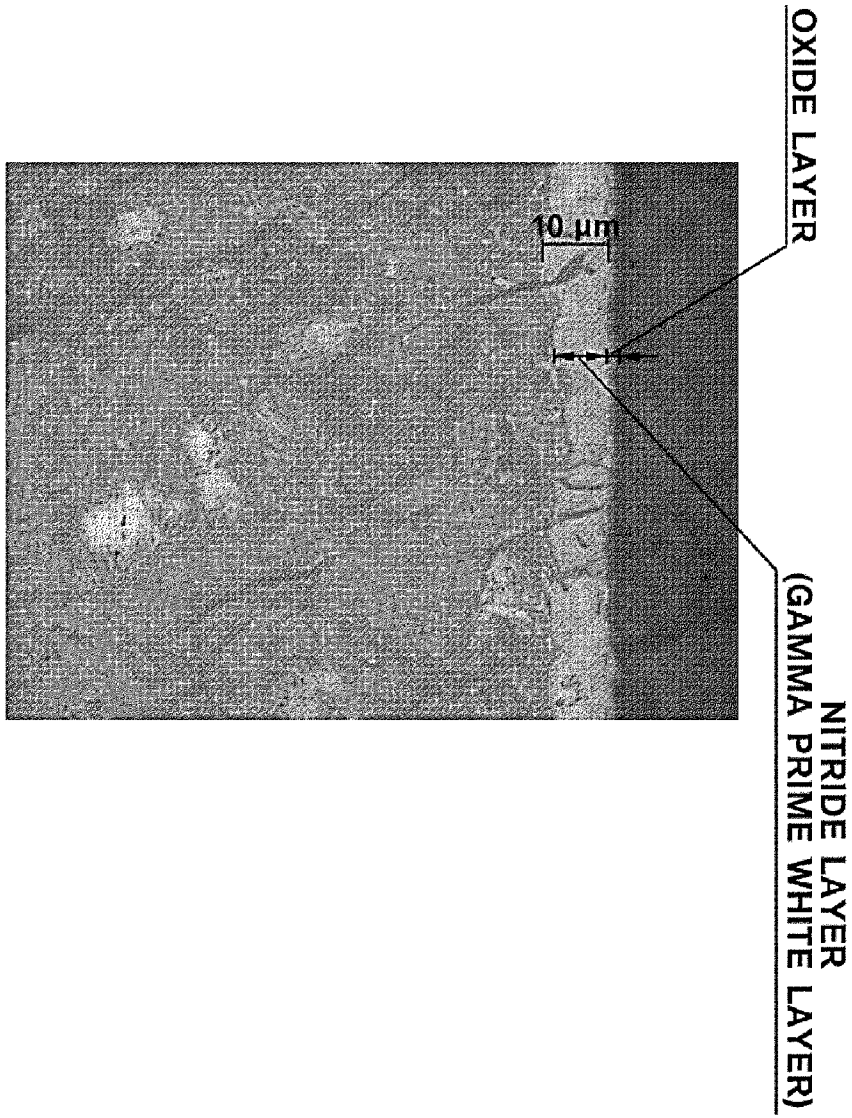
FIG. 5 is a cross-sectional photograph of the surface of a plasma ion nitrided and oxidized brake disc.

FIG. 4 is a graph illustrating a brake disc oxy-nitriding treatment method according to an embodiment of the present invention. FIG. 5 is a cross-sectional photograph of the surface of a plasma ion nitrided and oxidized brake disc.

The present invention relates to a plasma nitriding surface treatment method for a gray cast iron part. The surface treatment of the present invention inhibits generation of rust on the surface of the gray cast iron part and can improve the exterior characteristics thereof. The gray cast iron part can be selected from any parts conventionally formed from gray cast iron, such as a brake discs.

The present invention further relates to a nitriding process of a gray cast iron part, which improves the abrasion resistance of the gray cast iron part. Improved abrasion resistance is particularly beneficial for parts used as frictional materials. Further, the present invention relates to a nitriding process of a gray cast iron part that inhibits generation of $Fe_3O_4$ and $Fe_2O_3$ on the surface of the gray cast iron part, which typically results from a reaction between oxygen in the atmosphere and the gray cast iron.

According to an embodiment of the present invention, a plasma nitriding surface treatment method is carried out to form a nitride layer on the surface of frictional materials, such as gray cast iron parts (e.g., brake discs), using a plasma nitriding treatment method that enables phase control. By controlling the phase, generation of rust on the surface of the frictional materials can be inhibited and abrasion resistance can be improved. In particular, according to embodiments of the present invention, a plasma nitriding treatment method is carried out such that generation of a nitride layer of epsilon ($\epsilon$) phase is minimized, and generation of a nitride layer of gamma prime ($\gamma'$) phase is induced.

Since the nitride layer of epsilon ($\epsilon$) phase has brittleness and pores, if it is formed on a brake disc, then surface peeling may occur during braking. On the other hand, since the nitride layer of gamma prime ($\gamma'$) phase is dense in texture and speedy in diffusion of nitrogen atoms, it can provide improved abrasion resistance. Accordingly, it is preferable to form more gamma prime phase than epsilon phase or compound phase (epsilon phase+gamma prime phase) when forming the nitride layer.

Also, it is desirable to inhibit generation of a diffusion layer which can deteriorate the face-to-face attack of a frictional material upon braking due to strong brittleness.

In a plasma nitriding surface treatment method for a gray cast iron part according to an embodiment of the present invention, a plasma ion nitriding method may be carried out so as to minimize a typical epsilon phase or compound phase and maximize the gamma prime phase.

According to an exemplary embodiment, a gray cast iron part (e.g., brake disc) is first charged into a furnace, and then the temperature of the furnace is suitably increased, preferably to a temperature of about 400° C. to about 500° C.

The conditions of the plasma nitriding treatment can vary, and in embodiments when ammonia and reactant gases $N_2$, $H_2$ and $CH_4$ are injected into the furnace, the gray cast iron part may be treated by plasma ion nitriding for about 120 minutes to about 300 minutes at a temperature of about 400° C. to about 550° C. to form a nitride layer.

After the optimum gamma prime phase is formed, further processing may be carried out in order to maintain the corrosion resistance of the surface. For example, according to various embodiments, the surface of the gray cast iron on which the nitride layer has been formed may be selectively oxidized to form an oxide layer.

When the oxide layer is formed, oxidation may be performed in a salt bath furnace or by atmospheric moisture. About 120 minutes to about 300 minutes after the nitride layer has been completely generated, the disc may be taken out of the furnace, and may then be cooled directly at a suitable temperature, such as about 25° C. to about 30° C., to induce oxidation at the atmosphere.

Alternatively, nitriding can be carried out for about 30 minutes or less at a temperature range from about 400° C.~about 550° C., followed by oxidation at about 200° C.~about 500° C., followed by cooling the disc in the furnace. An oxygen atmosphere or moisture may be inputted into the furnace for oxidation such that the formation of a porous layer on the surface can be inhibited and the infiltration of nitrogen atoms can be facilitated.

The salt bath oxidation process may be performed for about 20 minutes to about 60 minutes to inhibit deformation of the part itself, and the oxidation duration may be maintained for about 20 minutes to about 60 minutes to sufficiently generate the oxide layer.

After the oxide layer is generated on the surface of the gray cast iron part, the part may be cooled in the air or in the furnace.

The ion nitriding surface treatment method according to the present invention provides numerous benefits.

Contrary to a typical oxy-nitriding method, the plasma ion nitriding method according to the present invention enables phase control. As such, the plasma ion nitriding method of the present invention allows for a reduction in generation of a nitride layer of an epsilon phase, and induction of a nitride of a gamma prime phase in the depth direction from the surface of a part.

According to various embodiments, the diffusion depth of infiltrated nitrogen may be modified by varying the temperature of a treated article, the internal pressure of the furnace, the ratio of nitrogen gas, and/or the treatment time.

The gamma prime phase is two times faster than the epsilon phase in the diffusion speed (diffusion coefficient) of a nitrogenous compound in a compound layer. Thus, by preventing the generation of the epsilon phase during the generation of the compound layer, and generating a single phase of the gamma prime, the diffusion speed of nitrogen atoms can be increased.

Also, when a compound phase (epsilon+gamma prime phase) is generated instead of a single phase, the brittleness may be increased due to a lattice structure difference (face-centered cubic (FCC) and hexagonal close-packed (HCP)). Accordingly, inducing the generation of a single phase may be advantageous for application to a frictional surface.

In order to achieve such a structure, carbon may be inhibited at an ion nitriding atmosphere to induce generation of the single phase of the gamma prime and inhibit generation of the compound phase.

Also, in a carbonless condition where the content of nitrogen is greater than that of hydrogen, and where nitrogen and hydrogen each exceed about 0.25%, respectively, the single gamma prime phase may be induced.

The thickness of the compound layer may be modified as desired by varying the sputtering speed, the condensation speed, and/or the treatment temperature.

For example, at a very high sputtering speed (high voltage), a compound layer may not be formed even when the treatment time is considerably prolonged.

Since the generation of the gamma prime single phase increases only if carried out for at least two hours, the single phase may be formed having a thickness within a range of about 6 μm to about 8 μm when carried out for about 2 hours to about 5 hours. Generally, the increase of the gamma prime single phase occurs during the first two hours, after which time it becomes saturated.

Although the ion nitriding temperature affects thickness such that an increase in thickness occurs by increasing iron nitriding temperature, the temperature should not be too high due to the tempering temperature of gray case iron materials. In particular, the ion nitriding treatment should be performed at a condition of about 550° C. or less because the tempering temperature of gray cast iron materials ranges from about 500° C. to about 580° C.

Also, upon precipitation, nitride shows a maximum strength at a temperature of about 400° C. to about 550° C. As such, it is preferable to maintain the temperature of the ion nitriding treatment within this range.

After a nitride layer of an optimum gamma prime phase is formed, a process for forming a surface oxide layer ($Fe_3O_4$) may be performed to maintain the corrosion resistance of the surface.

Oxidation treatment may be selectively performed on a disc or other part having a nitride layer that is formed with a single phase. For example, an oxide layer ($Fe_3O_4$) may be generated on the surface of a part using a salt bath or water vapor.

According to an embodiment of the present invention, the exterior of a part (e.g. frictional materials) can be improved by preventing generation of rust on the surface of the part, the abrasion resistance of the part can be improved and a reduction of the frictional coefficient can be prevented. Such benefits can be provided according to the present invention by controlling the phase of a nitride layer formed on the surface of gray cast iron through plasma ion nitriding treatment. In particular, the plasma ion nitriding is carried out so as to inhibit generation of an epsilon phase, which is brittle and porous and thus causes surface peeling upon braking, and induce generation of a single gamma prime phase, which has a dense texture and speedy nitrogen atom diffusion.

Further, after the formation of a nitride layer on the surface of gray cast iron, an oxidation treatment may be performed to inhibit the generation of a porous layer and facilitate the infiltration of nitrogen atoms, thus preventing the oxidation of the surface. The oxidation treatment can be carried out in a salt bath furnace or by exposure to atmospheric moisture. The salt bath oxidation process may be performed for about 20 minutes to about 60 minutes at a temperature of about 200° C. to about 500° C. to sufficiently generate an oxide layer.

The invention has been described in detail with reference to exemplary embodiments thereof. However, it will be appreciated by those skilled in the art that changes may be made in these embodiments without departing from the principles and spirit of the invention, the scope of which is defined in the appended claims and their equivalents.

What is claimed is:

1. A plasma nitriding surface treatment method for a gray cast iron part, comprising:

forming a nitride layer on a surface of the gray cast iron part by a selective ion nitriding treatment, and forming an oxide layer on the surface of the gray cast iron part after forming the nitride layer, wherein the oxide layer is formed using a salt bath oxidation process or vapor to inhibit formation of a porous layer and facilitate infiltration of nitrogen atoms, wherein the surface of the gray cast iron part is prevented from being deformed, and a frictional coefficient of the gray cast iron part is maintained.

2. The plasma nitriding surface treatment method of claim 1, wherein the ion nitriding treatment is performed by a plasma nitriding treatment process to minimize generation of an epsilon phase and induce generation of a gamma prime phase.

3. The plasma nitriding surface treatment method of claim 1, wherein the ion nitriding treatment is performed at a temperature of about 400° C. to about 550° C. for about 120 minutes to about 300 minutes.

4. The plasma nitriding surface treatment method of claim 1, wherein in an ion nitriding atmosphere during the ion nitriding treatment, carbon is inhibited to induce generation of a single phase of a gamma prime and inhibit generation of a compound phase of the gamma prime.

5. The plasma nitriding surface treatment method of claim wherein the oxide layer is ($Fe_3O_4$).

6. The plasma nitriding surface treatment method of claim 1, wherein the salt bath oxidation process is performed for about 20 minutes to 60 minutes to prevent oxidation of the surface of the part and deformation of the part and such that the nitride layer is corroded to reduce a total thickness of the nitride and oxide layers.

7. The plasma nitriding surface treatment method of claim 1, wherein in the forming of the oxide layer, a temperature of about 200° C. to about 500° C. is maintained to increase an infiltration depth of the oxide layer.

* * * * *